US005943019A

United States Patent [19]

Kawahata et al.

[11] Patent Number: 5,943,019

[45] Date of Patent: Aug. 24, 1999

[54] METHOD OF MOUNTING SURFACE MOUNTING ANTENNA ON MOUNTING SUBSTRATE ANTENNA APPARATUS AND COMMUNICATION APPARATUS EMPLOYING MOUNTING SUBSTRATE

[75] Inventors: Kazunari Kawahata; Ken Okada, both of Kyoto, Japan

[73] Assignee: Murata Manufacturing Co., Ltd., Japan

[21] Appl. No.: 08/802,243

[22] Filed: Feb. 19, 1997

[30] Foreign Application Priority Data

Feb. 19, 1996 [JP] Japan ..... 8-030906

[51] Int. Cl.[6] ..... H01Q 1/24

[52] U.S. Cl. ..... 343/702; 343/700 MS; 343/895

[58] Field of Search ..... 343/700 MS, 846, 343/873, 702, 895; H01Q 1/36, 1/24

[56] References Cited

U.S. PATENT DOCUMENTS

| | | | |
|---|---|---|---|
| 5,365,246 | 11/1994 | Rasinger et al. | 343/702 |
| 5,550,554 | 8/1996 | Erkocevic | 343/828 |
| 5,644,319 | 7/1997 | Chen et al. | 343/702 |
| 5,696,517 | 12/1997 | Kawahata et al. | 343/700 MS |

*Primary Examiner*—Hoanganh Le
*Assistant Examiner*—Hoang Nguyen
*Attorney, Agent, or Firm*—Ostrolenk, Faber, Gerb & Soffen, LLP

[57] ABSTRACT

A method of mounting a surface mounting antenna on a mounting substrate, which can improve the gain. An electromotive type surface mounting antenna is mounted in the vicinity of one corner defined by the intersection of two sides of a mounting substrate. The surface mounting antenna is mounted on the mounting substrate so that an open end of a radiation electrode of the surface mounting antenna faces in a direction away from at least one side of the two sides.

10 Claims, 7 Drawing Sheets

AVERAGE GAIN : −8. 5dB

AVERAGE GAIN : −12.2dB

AVERAGE GAIN : -8. 1 dB

AVERAGE GAIN : −11.4dB

METHOD OF MOUNTING SURFACE MOUNTING ANTENNA ON MOUNTING SUBSTRATE ANTENNA APPARATUS AND COMMUNICATION APPARATUS EMPLOYING MOUNTING SUBSTRATE

BACKGROUND OF THE INVENTION

1. Field of the Invention

The present invention relates to a method of mounting or packaging a surface mounting antenna on a mounting substrate, which is applicable to mobile body communication equipment such as a portable telephone system and radio LAN (Local Area Network) systems, and a communication apparatus equipped with this mounting substrate.

2. Description of the Related Art

Referring to FIG. 9, a description will be made hereinbelow of the prior method of mounting a surface mounting antenna on a mounting substrate. In the illustration, numeral 40 represents a surface mounting antenna which is mounted in the vicinity of one corner of the surface of a mounting substrate 41. In this surface mounting antenna 40, an L-shaped radiation electrode 42 and a supply electrode 43 are formed such that a gap g is interposed therebetween. However, in the case of the prior method of mounting the surface mounting antenna 40 on the mounting substrate 41, an open end 42*a* of the radiation electrode 42 of the surface mounting antenna 40 faces one side 41*a* of two sides constituting the aforesaid one corner of the mounting substrate 41 as indicated by an arrow, which lowers the gain. This is because an image current flowing in a ground electrode (a portion indicated by dotted lines) gathers in the vicinity of the one side 41*a* and an electromagnetic field in the Z direction (toward the upper end portion of the mounting substrate) wraps around an edge to produce a conductor loss. In addition, a communication apparatus having such a mounting substrate also causes the gain to lower.

SUMMARY OF THE INVENTION

Accordingly, it is an object of the present invention to provide a method of mounting a surface mounting antenna on a mounting substrate, which is capable of making the image current flow in the central portion of the mounting substrate to reduce the conductor loss, and further to provide a communication apparatus equipped with this mounting substrate.

For this purpose, in a surface mounting antenna mounting method according to the present invention, when an electromotive type surface mounting antenna is mounted in the vicinity of one corner defined by the intersection of two sides of a mounting substrate, the surface mounting antenna is mounted on the mounting substrate so that an open end of a radiation electrode of the surface mounting antenna faces in a direction away from at least one side of the two sides.

Furthermore, in accordance with this invention, the above-mentioned surface mounting antenna is constructed as an electromotive type surface mounting antenna, wherein the radiation electrode is bent to have a substantially L-shaped or substantially U-shaped configuration so that one end is open and the other end is short-circuited, and the radiation electrode and a supply electrode for exciting it are formed on one main surface of a base, made of a dielectric or magnetic substance, in a state where a gap is interposed therebetween, and the radiation electrode and the supply electrode are respectively connected to a ground terminal and a supply terminal formed on any one of end surfaces of the base.

Still further, in accordance with this invention, there is provided a communication apparatus equipped with a mounting substrate having the aforesaid surface mounting antenna.

As described above, according to this invention, since, when mounting the surface mounting antenna in the vicinity of one corner of the mounting substrate, the surface mounting antenna is mounted on the mounting substrate so that the open end of the surface mounting antenna faces in a direction of separating from at least one side of the two sides producing that corner, the image current flows in the central portion of the mounting substrate to lessen the wrapping of the electromagnetic field in the Z direction around the edge for reducing the conductor loss while increasing the gain. In addition, a communication apparatus having the mounting substrate equipped with this surface mounting antenna is also capable of improving the gain.

BRIEF DESCRIPTION OF THE DRAWINGS

The objects and features of the present invention will become more readily apparent from the following detailed description of the preferred embodiments taken in conjunction with the accompanying drawings in which.

DETAILED DESCRIPTION OF EMBODIMENTS OF THE INVENTION

Figure 1:
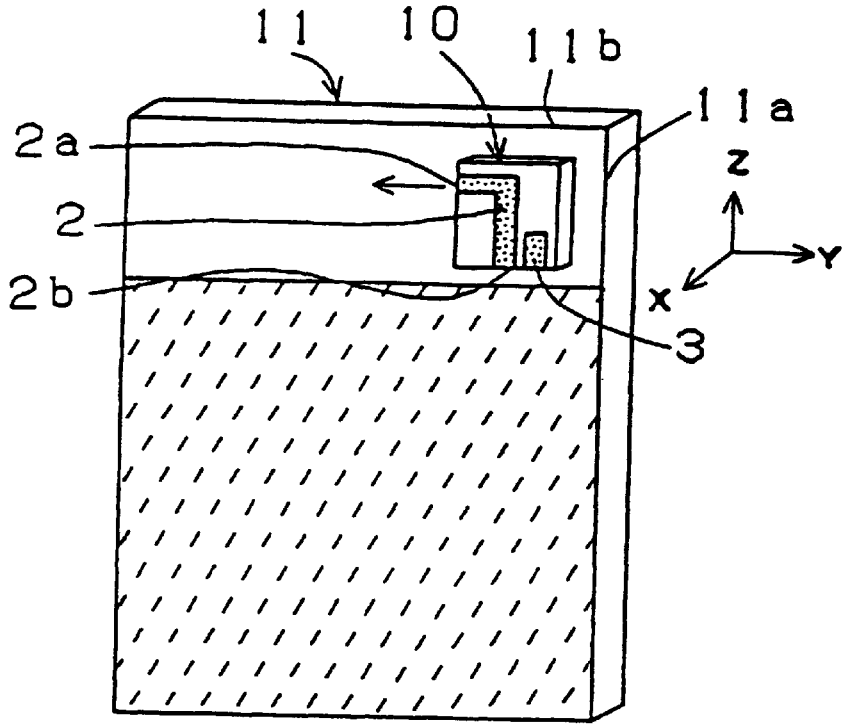
FIG. 1 is a perspective view useful for describing a method of mounting a surface mounting antenna on a mounting substrate according to the present invention.

Referring to the drawings, a description will be made hereinbelow of an embodiment of the present invention FIG. 1 is a perspective view useful for describing a method of mounting a surface mounting antenna on a mounting substrate. In the illustration, numeral 10 designates a surface mounting antenna which is also shown in an enlarged condition in FIG. 2. On a surface of a base 1 of the surface mounting antenna 10, made of a dielectric substance or magnetic substance, a radiation electrode 2 of $\lambda/4$ approximation and with an L-shaped configuration and a supply electrode 3 are formed in a state where a gap g is interposed therebetween. The radiation electrode 2 has an open end 2*a* at its one end and further has a short-circuited end 2*b* at its other end. This short-circuited end 2*b* is connected to a short-circuiting terminal 4 formed to extend over one end surface 1*a* and rear surface of the base 1, whereas the supply electrode 3 is connected to a supply terminal 5 made to extend over the one end surface 1*a* and rear surface of the base 1.

The supply electrode 3 and the open end 2*a* of the radiation electrode 2 are spaced by a distance d on average from each other and come into an electric field coupling to each other by a capacity Cd developed due to the separation of the distance d therebetween. Although the supply electrode 3 and the radiation electrode 2 are in the closest relation to each other by way of the gap g disposed therebetween, the short-circuited end 2*b* portion is inductive and hence the degree of coupling therebetween is small. On the other hand, although the supply electrode 3 and the open end 2*a* are separated from each other, the surface mounting antenna 10 itself is small in size so that the degree of coupling therebetween is relatively large.

With the above-described construction, the surface mounting antenna 10 can be mounted in the vicinity of one corner of a mounting substrate 11 as shown in FIG. 1 The surface antenna 10 is mounted on the mounting substrate 11 so that the opening end 2*a* of the radiation electrode 2 faces in a direction away from at least one side 11*a* of two sides or edges constituting one corner as indicated by an arrow. Owing to this mounting of the surface mounting antenna 10 on the mounting substrate 11, the image current flows in the central portion of the mounting substrate 11, with the result that the wrapping of the electromagnetic field in the Z direction around the edge is reducible to lessen the conductor loss. In this case, although not separating from the other side 11*b*, the separation from at least the one side 11*a* causes the gain to heighten.

Figure 3:
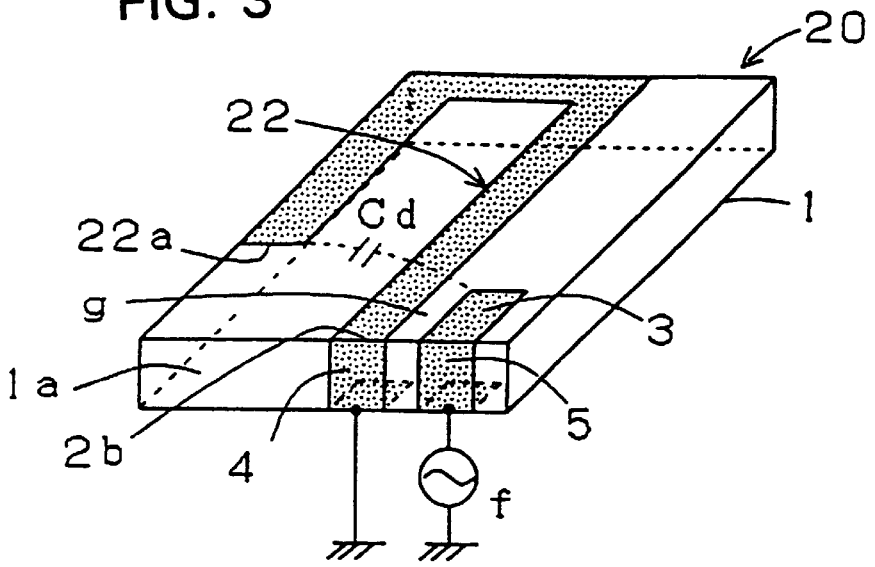
FIG. 3 is an enlarged perspective view showing another surface mounting antenna.
Figure 11:
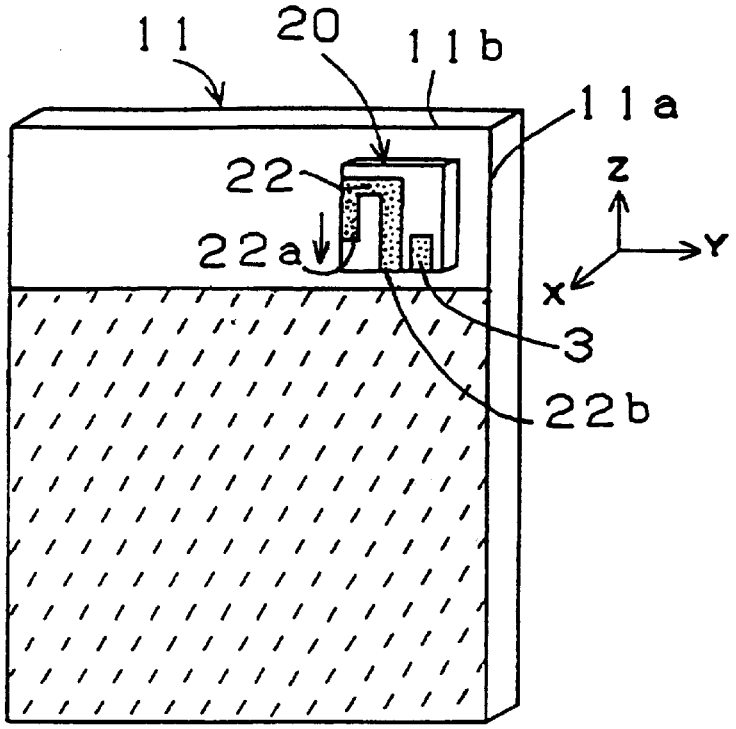
FIG. 11 shows the antenna apparatus of FIG. 3 mounted on a mounting substrate

FIG. 3 illustrates a surface mounting antenna 20 having a radiation electrode 22 with a substantially U-shaped configuration. Also with this structure, owing to a capacity Cd produced between an open end 22*a* of the radiation electrode 22 and the supply electrode 3, the supply electrode 3 and the radiation electrode 22 chiefly come into electromagnetic field coupling to each other. FIG. 11 shows the surface mounting antenna of FIG. 3 mounted on a mounting substrate 11.

Figure 4:
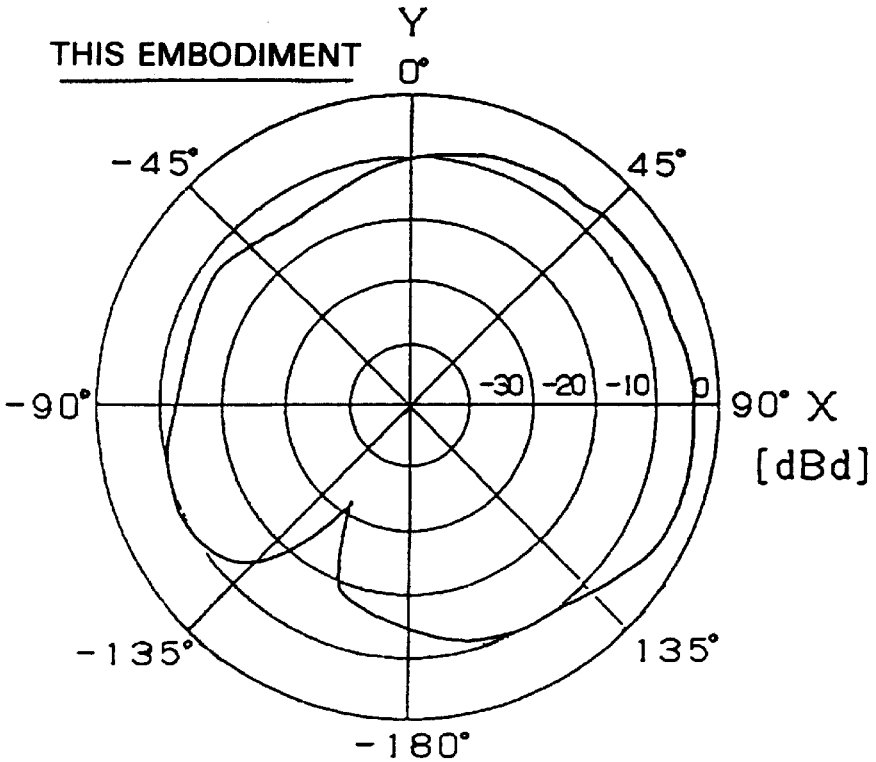
FIG. 4 is an illustration of a radiation pattern characteristic of a mounting substrate according to the invention in an X-Y plane.
Figure 5:
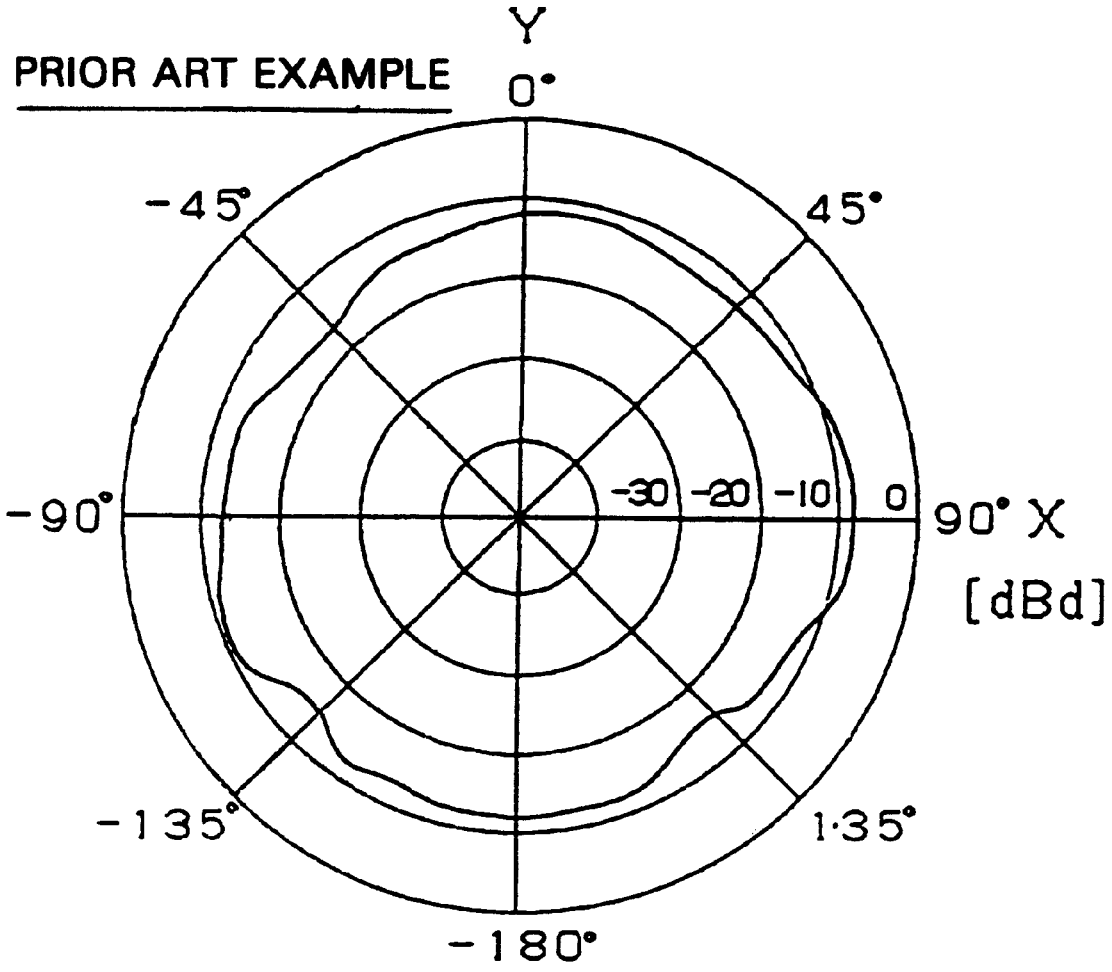
FIG. 5 is an illustration of a radiation pattern characteristic of a prior art mounting substrate in an X-Y plane.
Figure 6:
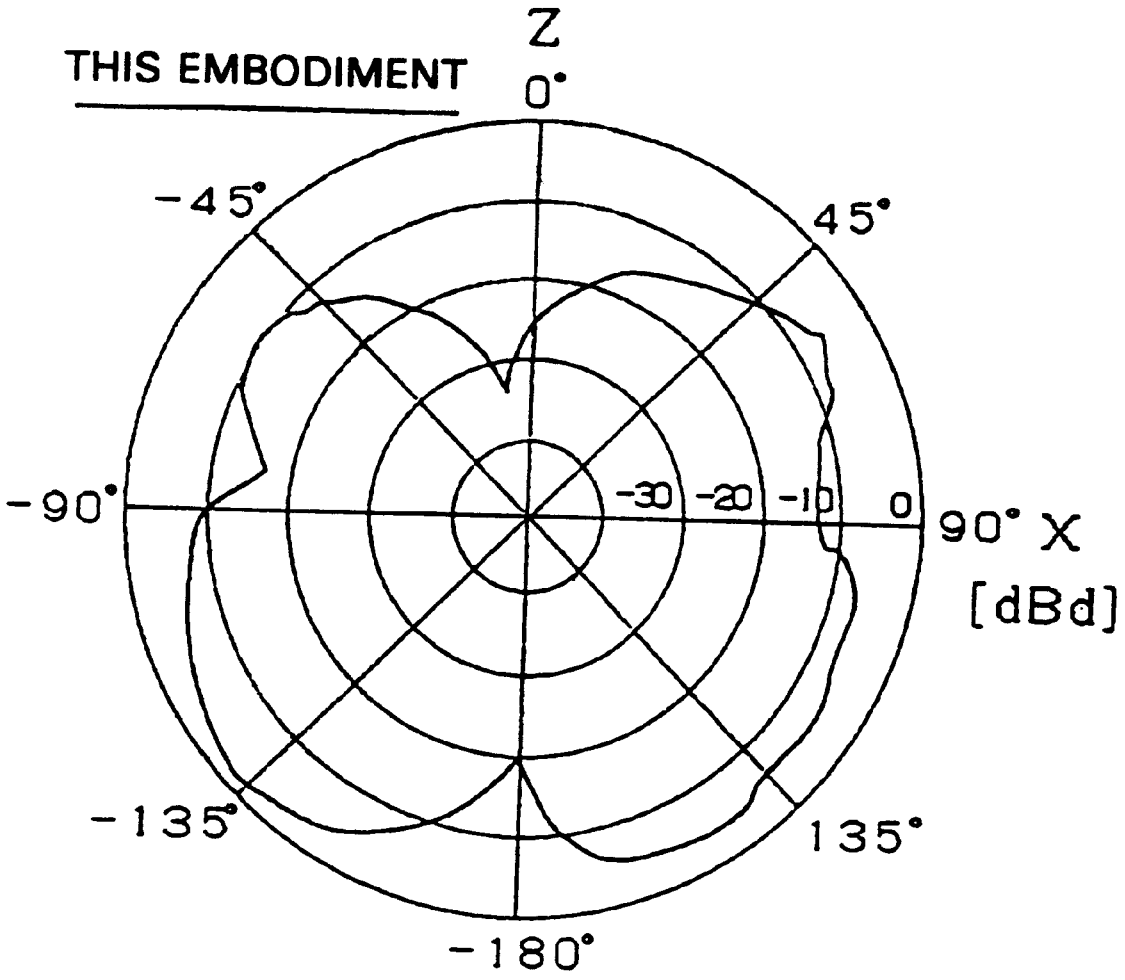
FIG. 6 is an illustration of a radiation pattern characteristic of a mounting substrate according to the invention in an X-Z plane.
Figure 7:
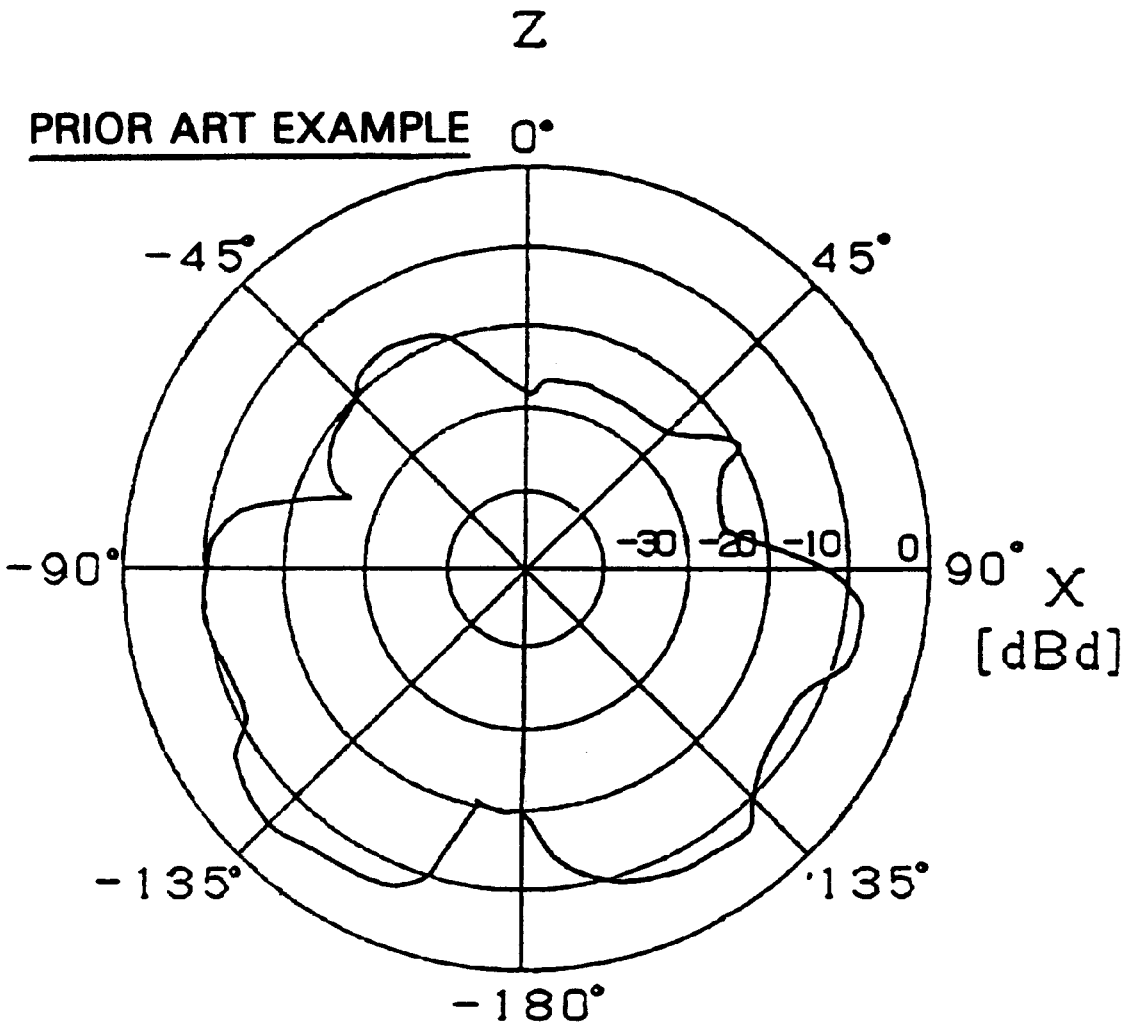
FIG. 7 is an illustration of a radiation pattern characteristic of a prior art mounting substrate in an X-Z plane.
Figure 9:
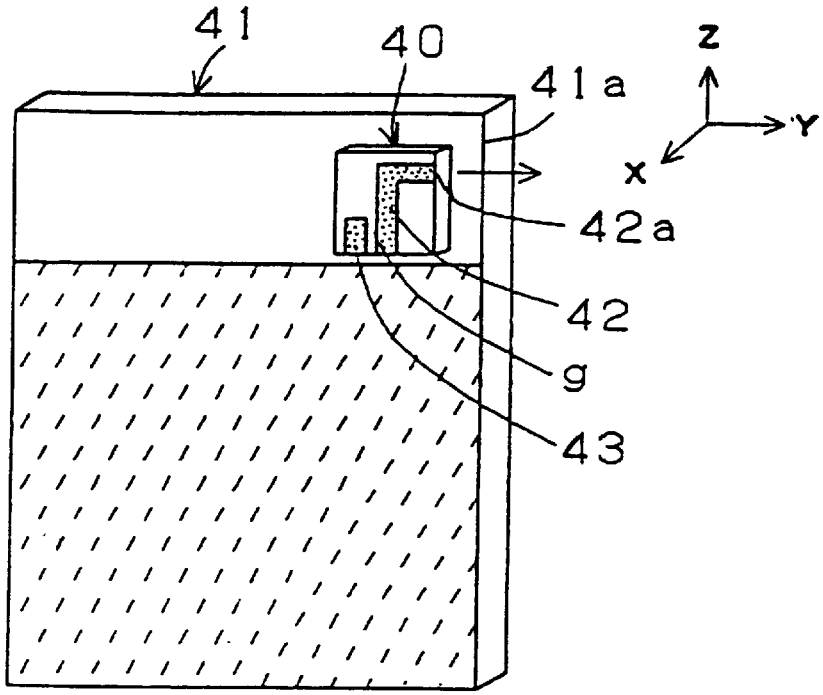
FIG. 9 PRIOR ART
FIG. 9 is a perspective view available for explaining a prior art method of mounting a surface mounting antenna on a mounting substrate.

Secondly, the radiation pattern characteristics of the mounting substrate of FIG. 1 and the prior art mounting substrate of FIG. 9 will be described hereinbelow with reference to FIGS. 4 to 7. FIGS. 4 and 5 show the radiation pattern characteristic of the FIG. 1 embodiment and the radiation pattern characteristic of the FIG. 9 prior art example in an X-Y plane, respectively. In the case of the embodiment shown in FIG. 4, the average gain is −8.5 dB at 1.9 GHz. On the other hand, in the case of the prior art example shown in FIG. 5, the average gain is −12.2 dB at 1.9 GHz. Further, FIGS. 6 and 7 show the radiation pattern characteristics of the FIG. 1 embodiment and the FIG. 9 prior art example in an X-Y plane, respectively. In the case of the embodiment shown in FIG. 6, the average gain is −8.1 dB at 1.9 GHz. On the other hands in the case of the prior art example shown in FIG. 7, the average gain is −11.4 dB at 1.9 GHz. As obvious from FIGS. 4 to 7, the average gain in the radiation pattern characteristic of this embodiment improves by 3 to 4 dB as compared with that of the prior art example.

Figure 8:
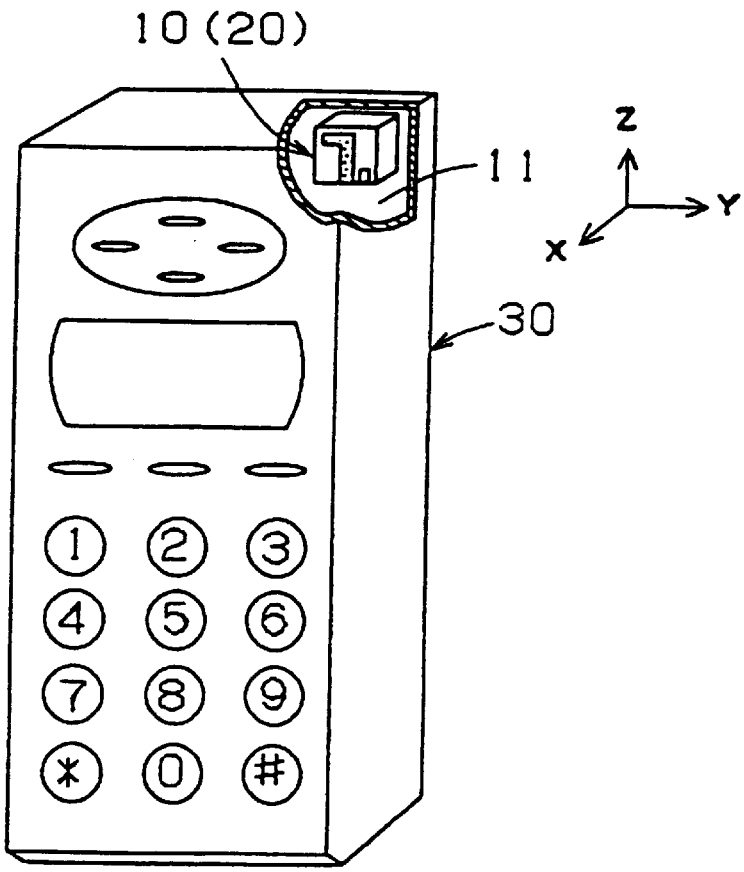
FIG. 8 is a perspective view showing a communication apparatus according to the invention.

Furthermore, referring to FIG. 8, a description will be made hereinbelow of a communication apparatus having a mounting substrate equipped with a surface mounting antenna according to the invention. The mounting substrate (or a sub-mounting substrate) 11 on which the surface mounting antenna 10 (20) is mounted as described above is installed in a communication apparatus 30. Also in this instance, its radiation pattern characteristics are similar to those as shown in FIGS. 4 and 6.

According to the invention, since, when a surface mounting antenna is mounted in the vicinity of one corner of a mounting substrate, the surface mounting antenna is mounted on the mounting substrate so that an open end of a radiation electrode faces in a direction away from at least one side of two sides constituting the corner, the image current passes through the central portion of the mounting substrate, with the result that the wrapping of the electromagnetic field in the Z direction around an edge is reducible to lessen the conductor loss so that the gain improves. In addition, a communication apparatus having the mounting substrate equipped with the surface mounting antenna mounted as mentioned before can also produce the improvement in the gain.

Figure 2:
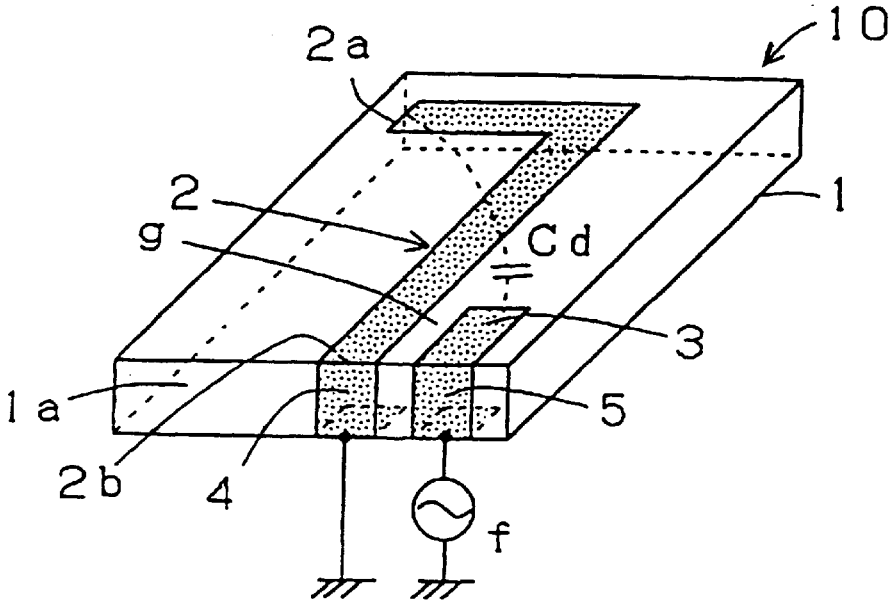
FIG. 2 is an enlarged perspective view showing the surface mounting antenna of FIG. 1.
Figure 10:
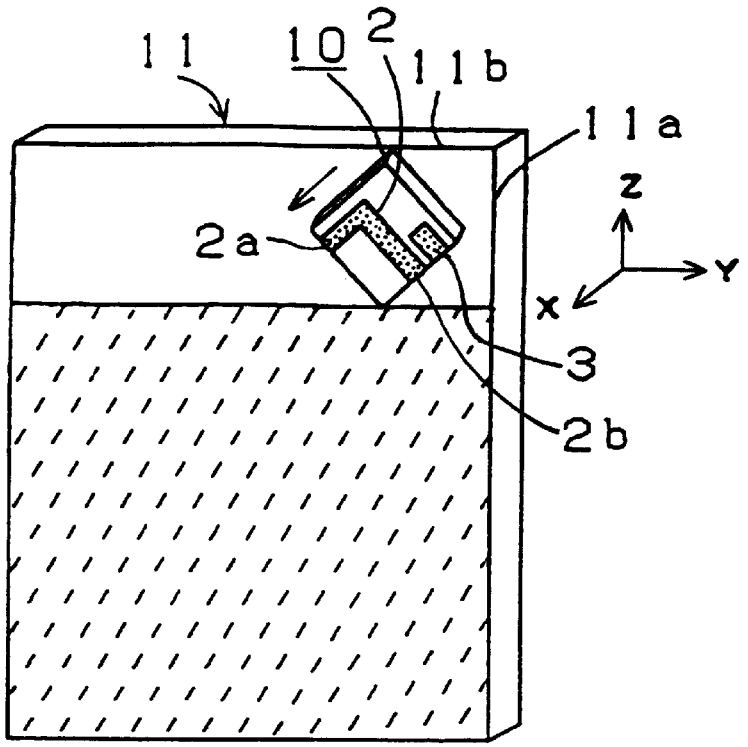
FIG. 10 is a perspective view showing the mounting of a surface mounting antenna on a mounting substrate according to another embodiment of the invention.

FIG. 10 shows another embodiment according to the present invention wherein the surface mounting antenna is mounted on a mounting substrate 11 such that the radiation electrode 2 of the embodiment of FIG. 2 is mounted so that the open end 2*a* thereof faces in a direction away from both of the two sides 11*a* and 11*b* adjacent the corner of the mounting substrate 11. As shown, the open end 2*a* faces in the direction of the arrow which is at an acute angle to both sides 11*a* and 11*b*.

It should also be pointed out that the radiation electrode 2, shown for example in FIG. 2, may also be formed as a single straight strip line, without having the bent portion 2*a*.

It should be understood that the foregoing relates to only preferred embodiments of the present invention, and that it is intended to cover all changes and modifications of the embodiments of the invention herein used for the purposes of the disclosure, which do not constitute departures from the spirit and scope of the invention.

What is claimed is:

1. A method of mounting a surface mounting antenna on a mounting substrate comprising the steps of: mounting an electromotive type surface mounting antenna in a vicinity of one corner defined by an intersection of two sides of said mounting substrate and disposing said surface mounting antenna on said mounting substrate with an open end of a radiation electrode of said surface mounting antenna facing in a direction away from at least one side of said two sides of the substrate.

2. The method of claim 1, further comprising forming said radiation electrode of said surface mounting antenna to have one of a substantially L-shaped configuration and a substantially U-shaped configuration with a first end portion being open and a second end portion being short-circuited, and arranging said radiation electrode and a supply electrode for exciting said radiation electrode with a gap therebetween on a main surface of the substrate comprising at least one of a dielectric substance and a magnetic substance, and connecting said radiation electrode and said supply electrode respectively to a ground terminal and a supply terminal formed on at least one end surface of said substrate.

3. A method of mounting a surface mounting antenna on a mounting substrate comprising the steps of: mounting an electromotive type surface mounting antenna in a vicinity of one corner defined by an intersection of two sides of said mounting substrate and disposing said surface mounting antenna on said mounting substrate with an open end of a radiation electrode of said surface mounting antenna facing in a direction away from at least one side of said two sides of the substrate and further comprising the step of disposing said surface mounting antenna on the mounting substrate such that the open end of the radiation electrode faces in a direction away from both said two sides of the substrate.

4. A method of mounting a surface mounting antenna on a mounting substrate comprising the steps of: mounting an electromotive type surface mounting antenna in a vicinity of one corner defined by an intersection of two sides of said mounting substrate and disposing said surface mounting antenna on said mounting substrate with an open end of a radiation electrode of said surface mounting antenna facing in a direction away from at least one side of said two sides of the substrate;

further comprising the step of disposing said surface mounting antenna on the mounting substrate such that the open end of the radiation electrode faces in a direction away from both said two sides of the substrate; and wherein the open end faces in a direction at an acute angle from both the two sides.

5. The method of claim 1, further comprising forming the radiation electrode substantially as a straight strip line.

6. A communication apparatus comprising at least one of an electromagnetic frequency transmitter circuit and an electromagnetic frequency receiver circuit and further comprising a surface mounting antenna disposed on a mounting substrate connected to at least one of the transmitter circuit and receiver circuit, the antenna comprising an electromagnetic surface mounting antenna mounted in a vicinity of one corner defined by an intersection of two sides of said mounting substrate, the surface mounting antenna being disposed on said mounting substrate with an open end of a radiation electrode of said surface mounting antenna facing in a direction away from at least one side of said two sides of the substrate.

7. The communication apparatus of claim 6, further wherein the radiation electrode of said surface mounting antenna has one of a substantially L-shaped configuration and a substantially U-shaped configuration with a first end portion being open and a second end portion being short-circuited, a supply electrode being disposed adjacent the radiation electrode, the supply electrode disposed adjacent the radiation electrode with a gap therebetween and being provided for exciting the radiation electrode, the radiation electrode and the supply electrode being provided on a main surface of the substrate comprising one of a dielectric substance and a magnetic substance, the radiation electrode and the supply electrode being connected respectively to a ground terminal and a supply terminal formed on at least one end surface of said substrate.

8. A communication apparatus comprising at least one of an electromagnetic frequency transmitter circuit and an electromagnetic frequency receiver circuit and further comprising a surface mounting antenna disposed on a mounting substrate connected to at least one of the transmitter circuit and receiver circuit, the antenna comprising an electromagnetic surface mounting antenna mounted in a vicinity of one corner defined by an intersection of two sides of said mounting substrate, the surface mounting antenna being disposed on said mounting substrate with an open end of a radiation electrode of said surface mounting antenna facing in a direction away from at least one side of said two sides of the substrate; and further wherein said surface mounting antenna is disposed on the mounting substrate such that the open end of the radiation electrode faces in a direction away from both said two sides of the substrate.

9. A communication apparatus comprising at least one of an electromagnetic frequency transmitter circuit and an electromagnetic frequency receiver circuit and further comprising a surface mounting antenna disposed on a mounting substrate connected to at least one of the transmitter circuit and receiver circuit, the antenna comprising an electromagnetic surface mounting antenna mounted in a vicinity of one corner defined by an intersection of two sides of said mounting substrate, the surface mounting antenna being disposed on said mounting substrate with an open end of a radiation electrode of said surface mounting antenna facing in a direction away from at least one side of said two sides of the substrate;

further wherein said surface mounting antenna is disposed on the mounting substrate such that the open end of the radiation electrode faces in a direction away from both said two sides of the substrate; and wherein the open end faces in a direction at an acute angle from both the two sides.

10. The communication apparatus of claim 6, further wherein the radiation electrode comprises substantially a straight strip line.

* * * * *